US006508946B1

(12) United States Patent
Murakami

(10) Patent No.: US 6,508,946 B1
(45) Date of Patent: Jan. 21, 2003

(54) METHOD FOR MANUFACTURING INK JET RECORDING HEAD, INK JET RECORDING HEAD, AND INK JET RECORDING APPARATUS

(75) Inventor: Keiichi Murakami, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 09/589,374

(22) Filed: Jun. 8, 2000

(30) Foreign Application Priority Data

Jun. 9, 1999 (JP) ..... 11-163005

(51) Int. Cl.[7] ..... B41J 2/16

(52) U.S. Cl. ..... 216/27; 216/2; 216/99; 427/154; 347/20; 347/44; 347/56

(58) Field of Search ..... 216/2, 27, 41, 216/49, 99; 427/133, 154, 207.1, 208.8; 347/20, 44, 56, 63

(56) References Cited

U.S. PATENT DOCUMENTS

| | | | | | |
|---|---|---|---|---|---|
| 4,313,124 | A | | 1/1982 | Hara | 346/140 R |
| 4,334,234 | A | * | 6/1982 | Shirato et al. | 347/65 |
| 4,345,262 | A | | 8/1982 | Shirato et al. | 346/140 R |
| 4,459,600 | A | | 7/1984 | Sato et al. | 346/140 R |
| 4,463,359 | A | | 7/1984 | Ayata et al. | 346/1.1 |
| 4,539,482 | A | * | 9/1985 | Nose | 250/208.1 |
| 4,558,333 | A | | 12/1985 | Sugitani et al. | 346/140 R |
| 4,723,129 | A | | 2/1988 | Endo et al. | 346/1.1 |
| 4,740,796 | A | | 4/1988 | Endo et al. | 346/1.1 |
| 4,789,425 | A | * | 12/1988 | Drake et al. | 216/16 |
| 4,985,534 | A | * | 1/1991 | Heinz et al. | 528/272 |
| 5,112,552 | A | * | 5/1992 | Wittmann et al. | 264/255 |
| 5,187,499 | A | | 2/1993 | Murakami | 346/140 R |
| 5,342,918 | A | * | 8/1994 | Howelton et al. | 525/420 |
| 5,357,139 | A | * | 10/1994 | Yaguchi et al. | 257/666 |
| 5,743,775 | A | * | 4/1998 | Baurmeister | 2/16 |

FOREIGN PATENT DOCUMENTS

| | | |
|---|---|---|
| EP | 0 750 992 | 1/1997 |
| JP | 54-56847 | 5/1979 |
| JP | 59-123670 | 7/1984 |
| JP | 59-138461 | 8/1984 |
| JP | 60-71260 | 4/1985 |
| JP | 62-264957 | 11/1987 |

* cited by examiner

*Primary Examiner*—Randy Gulakowski
*Assistant Examiner*—Jiri Smetana
(74) *Attorney, Agent, or Firm*—Fitzpatrick, Cella, Harper & Scinto

(57) ABSTRACT

The present invention relates to a method for manufacturing an ink jet recording head using wet etching, the method providing a high production efficiency, an ink jet recording head manufactured by this method, and an ink jet recording apparatus using this recording head. A silicon substrate, constituting a recording head, has functional elements formed thereon and including heat-generating resister elements and a drive circuit therefor, a protective layer is formed on the silicon substrate for protecting the functional elements from an etchant that is in contact with a substrate surface via an adhesive layer, and an ink supply port is formed by means of wet etching. The adhesive layer allows the protective layer to adhere well to the substrate to appropriately prevent the functional elements from being damaged by the etchant.

9 Claims, 3 Drawing Sheets

METHOD FOR MANUFACTURING INK JET RECORDING HEAD, INK JET RECORDING HEAD, AND INK JET RECORDING APPARATUS

This application is based on Japanese Patent Application No. 11-163005 (1999) filed Jun. 9, 1999, the content of which is incorporated hereinto by reference.

BACKGROUND OF THE INVENTION

1. Field of the Invention

The present invention relates to a method for manufacturing an ink jet recording head, an ink jet recording head, and an ink jet recording apparatus, and in particular, to a method for manufacturing an ink jet recording head by means of wet etching using an etchant.

2. Description of the Related Art

To manufacture a so-called "side-shooter type" ink jet recording head that injects inks in a substantially perpendicular direction onto a substrate having injection energy generating elements, ink supply ports are produced by forming through-holes in the substrate having the ink injection energy generating elements. In this type of recording head, the inks are supplied from a rear side of the substrate via the ink supply ports.

Methods for manufacturing such an ink jet recording head are known, for example, from Japanese Patent Application Laid-open No. 62-264957 (1987) and U.S. Pat. No. 4,789,425. These methods use mechanical processing such as sand blasting or ultrasonic grinding to form the above described through-holes in the substrate with the injection energy generating elements formed thereon and then form grooves constituting ink channels. The ink channels or the like may be formed before the throughholes. Then, an electroforming plate with ink injection openings formed therein is bonded to the substrate while aligning the ink injection openings with the ink channels or the like in the substrate.

To achieve a reduced size, an increased density, or the like, recently known ink jet recording heads have an electric drive circuit (a diode matrix circuit or a shift register circuit) formed on the substrate for driving the injection energy generating elements. When such highly-functional recording heads are manufactured and if the above described mechanical processing such as sand blasting or ultrasonic grinding is used to form the ink supply ports, relatively much attention must be paid to handling of the processing. This is because the above described drive circuit is very sensitive to static electricity and vibration, so that the above processing method may affect the characteristics of the circuit.

Thus, as means for solving this problem, a method has been proposed which uses silicon as a substrate material and which uses wet etching to form the through-holes for the ink supply ports from the rear surface of the substrate. Since this method forms the through-holes by means of chemical etching, which step of the ink jet recording head manufacturing process is used for this formation can be set substantially arbitrarily. That is, the through-holes can also be formed during the final step where principal functional parts of the ink jet recording head have already been formed. Compared to the formation of the ink supply ports based on the mechanical processing which is executed relatively early during the recording head manufacturing process, the method allowing the through-holes to be formed during the final step can advantageously solve problems such as a decrease in the strength of the substrate caused by the through-holes formed during an initial step, the decrease in turn making handling of the substrate complicated during the subsequent manufacturing steps.

In the wet etching for silicon, anisotropic etching using an alkaline etchant is commonly performed, which has the advantage of increasing the density of a formed circuit pattern or the like. An etching mask for an etching start surface is composed of an inorganic film, for example, a silicon oxide film or a silicon nitride film. The etchant is prepared from TMAH (tetramethylammonium hydroxide), KOH, hydrazine, or the like which provides different etching speeds depending on crystal faces.

With such wet etching, the substrate with the injection energy generating elements and a circuit of drive elements therefor formed thereon has its top surface (hereinafter, referred to as "device surface") exposed to the etchant, a configuration for protecting these circuits is required. Conventionally known such configurations include a method of using a jig to cover the circuit on the substrate in order to protect them from the etchant, a method of bringing the etching start surface (rear surface) of the silicon substrate into contact with a bath with the etchant overflowing therefrom, without immersing the substrate in the etchant, and a method of applying an etching-protective film to a device surface of the substrate before etching.

However, these configurations for protecting the device surface of the substrate from the etchant have the following problems:

With the method of using the jig for the device surface of the substrate or bringing the etching start surface of the substrate into contact with the overflowing surface of the etchant, inappropriate setting of the jig on the substrate or inappropriate control of the overflowing etchant surface may cause the etchant to flow onto the top surface of the substrate to damage functional elements such as the injection energy generating elements and drive elements as well as their circuit. The damage to the circuit means corrosion of exposed wiring of the circuit and/or an electrode section with the etchant or destruction of the injection energy generating elements and drive elements therefor.

Further, the above methods of using the jig and bringing the substrate into contact with the overflowing substrate are disadvantageous in productivity, particularly, in efficiency. That is, massive batch processing, which is an advantage of wet etching, is difficult with these methods.

In general, TMAH is used as the etchant taking safety and adverse effects on environments into consideration. In this case, the etching requires 10 to 30 hours if the silicon substrate has a thickness of, for example, 625 $\mu$m. Consequently, this method requires a very long time for a massive batch process and is thus substantially incompatible with such a process, resulting in a reduced production efficiency.

The another above-described method for protecting the functional elements and circuit on the substrate, that is, the method of coating an etching-protective layer on the device surface of the substrate forms the protective film by coating the device surface with a molten wax or the like or coating and drying a negative-type photoresist thereon. Although, however, such a protective film is not modified by alkaline etchants, it does not adhere to a ground layer (as a protective layer for the circuit, an inorganic film, for example, a silicon dioxide film, a silicon nitride film, or the like is typically formed between the substrate and the protective layer) and may be released from the substrate (particularly from its peripheries). As a result, the circuit and elements on the substrate, especially exposed wirings and electrodes of the circuit, tantalum(Ta) used in a protection for heater materials, and defects or inefficiently covered portions of the ground layer, may come in contact with the etchant and may be damaged.

It is an object of the present invention to solve the above described problems of the prior art in order to provide a method for manufacturing an ink head recording head using wet etching, the method being able to carry out etching while maintaining a high production efficiency, an ink jet recording head manufactured using this method, and an ink jet recording apparatus using this ink jet recording head.

SUMMARY OF THE INVENTION

To attain the above object, a method for manufacturing an ink jet recording head according to the present invention is characterized by comprising the steps of providing a substrate having a device surface with elements constituting an ink jet recording head, forming an adhesive layer in peripheries of the device surface, forming, in contact with the adhesive layer, an etching-protective layer for protecting the device surface from an etchant, etching the substrate by the etchant, and removing the etching-protective layer.

In addition, an ink jet recording head according to the present invention is characterized by being manufactured by means of a manufacturing method comprising the steps of providing a substrate having a device surface with elements constituting an ink jet recording head, forming an adhesive layer in peripheries of the device surface, forming, in contact with the adhesive layer, an etching-protective layer for protecting the device surface from an etchant, etching the substrate by the etchant, and removing the etching-protective layer.

Further, an ink jet recording apparatus is characterized by carrying out recording using an ink jet recording head for injecting inks, the ink jet recording head being manufactured by means of a manufacturing method comprising the steps of providing a substrate having a device surface with elements constituting an ink jet recording head, forming an adhesive layer in peripheries of the device surface, forming, in contact with the adhesive layer, an etching-protective layer for protecting the device surface from an etchant, etching the substrate by the etchant, and removing the etching-protective layer.

In the above configuration, when the protective layer for the etchant is used, the adhesive layer is formed on areas where the protective layer and the substrate are in contact. Consequently, the adhesion between the protective film and the substrate can be improved to prevent the functional elements and circuit in the ink jet recording head from being damaged by the etchant. As a result, when ink supply ports are formed by means of wet etching, the device surface is protected from damage, thereby enabling manufacturing of an ink jet recording head with a high yield and an improved production efficiency.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described below in detail with reference to the drawings.

FIGS. 1A to 1H are diagrams showing, in the order of steps, a process for manufacturing an ink jet recording head according to an embodiment of the present invention. The recording head according to this embodiment is based on the so-called bubble-jet method. The recording head according to this embodiment uses as injection energy generating elements, heat-generating resister elements that generate thermal energy. This thermal energy is used to generate bubbles in an ink so that the ink is injected due to a pressure applied by the bubbles. FIGS. 1A to 1H represent sectional views of a single nozzle in the recording head having a unit (pair) of heat-generating resister elements, an ink channel, an injection opening, or the like. Of course, this embodiment enables manufacturing of a multiple-nozzle recording head formed by arranging plural units of the above described components on a silicon substrate and also allows a plurality of multiple-nozzle recording heads to be simultaneously manufactured from one substrate as in general semiconductor manufacturing techniques.

In manufacturing the recording head according to this embodiment, heat-generating resister elements 2, and functional elements such as drive elements for driving the heat-generating resister elements as well as a circuit thereof are first formed on a (100) surface of a silicon substrate 1 in the same manner as in the semiconductor manufacturing techniques. FIGS. 1A–1H show only the heat-generating resistor elements 2. Then, peripheral electrodes are formed for supplying current to the heat-generating elements 2. The detailed description of this step is omitted. Additionally, the manner of producing the peripheral electrodes is not particularly limited.

Figure 1A:
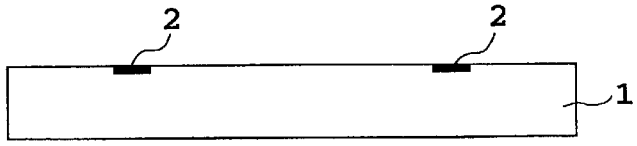
FIGS. 1A to 1H are diagrams showing a process for manufacturing an ink jet recording head according to an embodiment of the present invention.
Figure 1B:
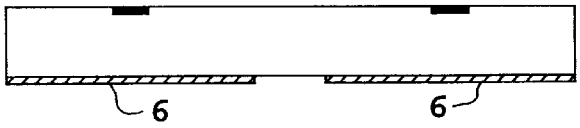

Next, at the step shown in FIG. 1B, an etching mask 6 is formed on an etching start surface (that is, a rear surface of the silicon substrate 1) by means of the photolithography technique so that ink supply ports, described below, can be formed using the mask. The etching mask has only to resist an alkaline etchant used for the process and is principally composed of a silicon oxide film, a silicon nitride film, or the like. Preferably, the etching mask has a thickness of not less than 1 $\mu$m, in order to avoid pinhole defects.

Figure 1C:
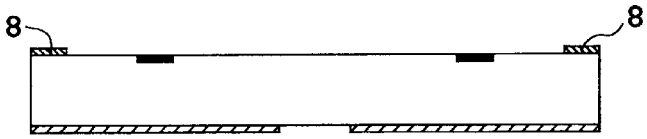

At the step shown in FIG. 1C, an adhesive layer 8 according to an embodiment of the present invention is formed. The adhesive layer 8 is formed to improve the adhesion of an etching-protective layer 9 (formed during a subsequent step) to a surface of the substrate with the heat-generating elements and a drive circuit formed thereon, that is, a device surface. The adhesive layer 8 is formed in peripheries of the substrate so as to surround an interior thereof as shown in FIG. 1C. A preferable material of the adhesive layer 8 have a resistance to alkaline etchants, an good adhesion to the device surface, which has a silicon oxide or nitride film as a circuit protective film, and also a good adhesion to the etching-protective layer 9. That is, compared to the unitary use of the above described etching-protective layer containing wax or rubber, the additional use of the adhesive layer 8 improves the adhesion of the etching-protective layer to the device surface, thereby enabling the functional elements and circuit on the device surface to be protected appropriately.

Figure 2:
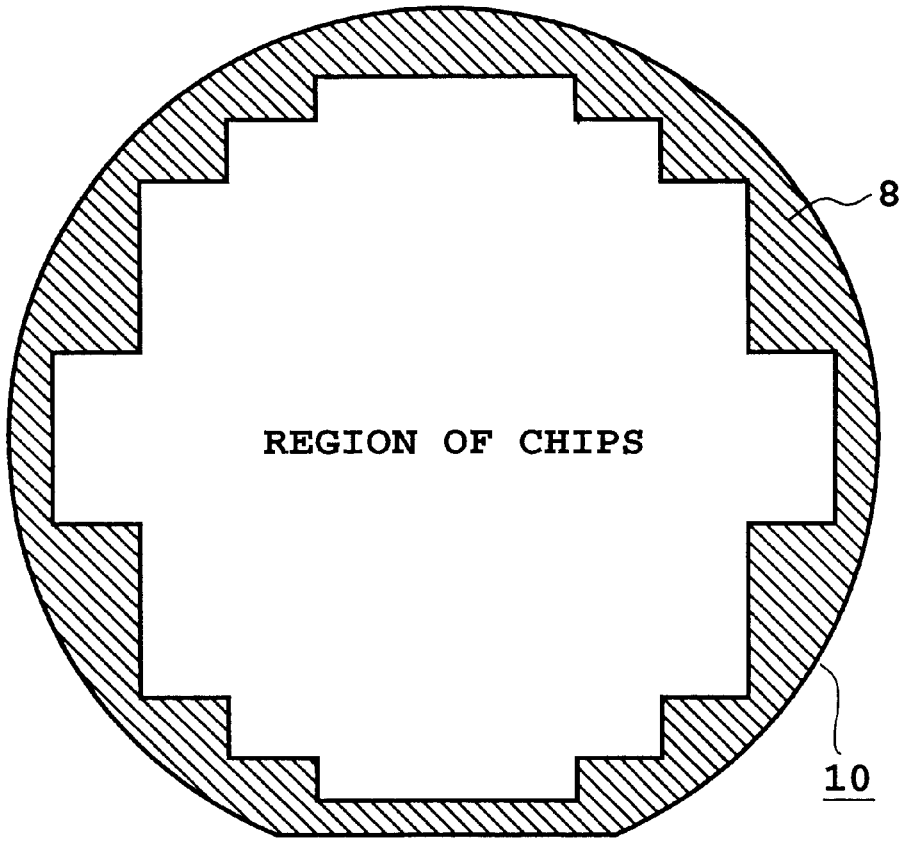
FIG. 2 is a diagram showing a silicon substrate for use in this manufacturing process.

As shown in FIG. 2, for a silicon substrate 10 for simultaneously manufacturing a plurality of ink jet recording head chips, the adhesive layer 8 may be formed in outer peripheral portions of the silicon substrate instead of being formed around each of the ink jet recording head. By forming the adhesive layer 8 in the above manner and subsequently coating the entire surface of the silicon substrate 10 with the etching-protective layer 9, described below, the etchant can be prevented from infiltrating into the device surface of the substrate.

Additionally, the configuration of the adhesive layer is not limited to the above description, but in addition to the adhesive layer formed in peripheries of the substrate, another adhesive layer may be provided in an interior of the substrate where drive element or the like is formed. The adhesive layer may also be used directly as a protective layer for the drive element or the like.

Materials of the adhesive layer have only to meet the above described requirements. Particularly preferable materials are poly-etheramide resins, which have the advantages of resistance to alkaline etching and good adhesion to inorganic films such as silicon oxide films and which can also be used as a protective film for the ink jet recording head. Preferable poly-etheramide resins include HIMAL HL-1200 (manufactured by Hitachi Chemical Co., Ltd.)), for example.

In this example, the HIMAL HL-1200 was coated using a spinner, so as to have a thickness of 2 $\mu$m. The substrate was dried at 100° C. for 30 minutes and then at 250° C. for 60 minutes. Subsequently, the photolithography technique was used to pattern the resulting layer, for example, as shown in FIG. 1C or 2. This patterning can be executed in the same manner as in typical dry etching of an organic film. For example, the layer can be etched by using a positive-type photoresist as a mask and using oxygen plasma.

The adhesive layer 8 may have a film thickness between 0.5 and 5 $\mu$m and preferably between about 1 and 3 $\mu$m. If the film thickness is smaller than 0.5 $\mu$m, defects such as pin-holes are likely to occur. On the other hand, if the film thickness is larger than 5 $\mu$m, the layer may obstruct subsequent steps, for example, photolithography operations in the steps described below. The adhesive layer 8 preferably has a width of not less than 100 $\mu$m, and more preferably not less than 500 $\mu$m.

Figure 1D:
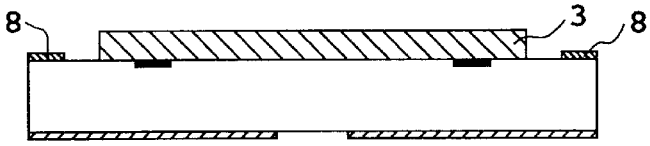

Next, as shown in FIG. 1D, a molding member 3 that can be removed later is formed by means of the photolithography technique. As described below, this molding member does not only function as a layer for stopping etching during alkaline wet etching but also forms an ink channel after being removed. The molding member 3 preferably has a thikness of 5 to 30 $\mu$m. In this embodiment, the molding member 3 was formed so as to have a predetermined thickness and pattern using the positive-type photoresist PMER-AR900 (manufactured by TOKYO OHKA KOGYO Co., Ltd.)).

Figure 1E:
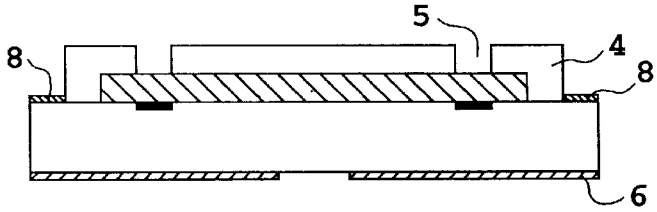

At the step shown in FIG. 1E, an orifice plate member 4 including injection openings 5 is formed by means of the photolithography technique so as to cover the molding member 3 formed in FIG. 1D. The orifice plate member may be composed of a photosensitive epoxy resin, a photosensitive acrylic resin, or the like.

Figure 1F:
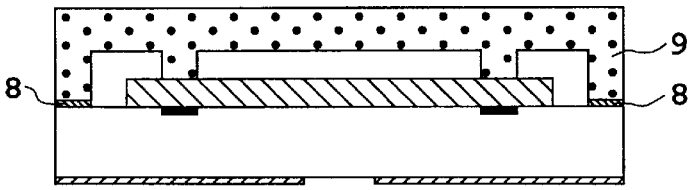

Further, at the step shown in FIG. 1F, the etching-protective layer 9 is formed. That is, the protective layer is formed on the device surface of the silicon substrate for protecting the components thereof from wet etchants used during subsequent steps. Since the etching-protective layer 9 adheres well to the adhesive layer 8 formed in peripheries of the substrate 1, the etchant is appropriately prevented from infiltrating through areas where the protective layer 9 and the adhesive layer 8 are in contact, to the device surface under the protective film.

Preferably, the etching-protective layer 9 should resist alkaline etchants; should have a great difference in etching rate from the substrate 1; and should appropriately adhere particularly to the adhesive layer 8 to prevent the functional elements such as the heat-generating resister elements and the structures to be protected such as the orifice plate member from being chemically affected. It is also preferable that the etching-protective layer 9 can be removed easily after etching. The etching-protective layer can be composed, for example, of a cyclized rubber-based resin or a wax. The cyclized rubber-based resin is particularly preferable because it can be coated at the room temperature and because it exhibits excellent resistance to alkaline etchants and, particularly, adhesion to the above described adhesive layer.

The cyclized rubber-based resin may be a negative-type photoresist as conventionally used for photolithography, or its analogues that are free from photosensitive groups. Such a material includes, for example, OMR-83 (negative-type photoresist) and OBC (that is free from photosensitive groups) both manufactured by TOKYO OHKA KOGYO Co., Ltd. If the OBC is used, it is coated using a spinner and is then dried to form the etching protective layer 9. The etching-protective layer 9 is between 5 and 100 $\mu$m and preferably between 10 and 50 $\mu$m in film thickness. If the film thickness is smaller than 5 $\mu$m, defects such as pin-holes are likely to occur. On the other hand, if the film thickness is larger than 100 $\mu$m, it will be difficult to coat and dry this layer. In addition, the layer can be dried either in an oven or on a hot plate. The drying is desirably carried out between 90 and 100° C. for about 30 to 90 minutes and more desirably 10 at 100° C. for 30 minutes. This is because baking at high temperature over a long time makes later releasing difficult. Furthermore, the etching-protective layer 9 may be coated so as to over edges of the substrate to partly cover the etching mask. In this case, of course the adhesive layer 8 is provided on the rear surface of the substrate similarly to the front surface.

Figure 1G:
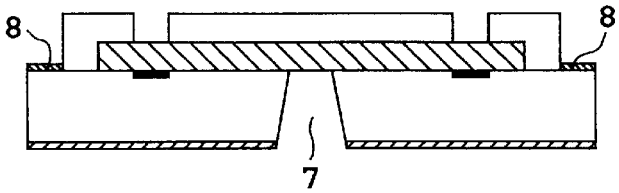

Next, at the step shown in FIG. 1G, anisotropic wet etching is used to form a through-hole, that is, an ink supply port 7 in the silicon substrate 1. In this embodiment, by preparing a 22 wt. % solution of TMAH as an etchant and using the molding member 3 as an etching stopping layer, the anisotropic etching was carried out at an etching temperature of 80° C. for 18 hr. The period of etching is dependent on materials to etch, an etchant used etc. and can be determined easily by the one skilled in the art. It is the advantage that this step can be performed massively using a conventinal etching apparatus, in spite of relatively long processing time.

After the etching, the etching-protective layer 9 is released. The etching-protective layer 9 can be released in various manners depending on the characteristics of its material. For the OBC, which was used for this embodiment, xylene can be used for releasing. The releasing method includes dipping and spraying.

Figure 1H:
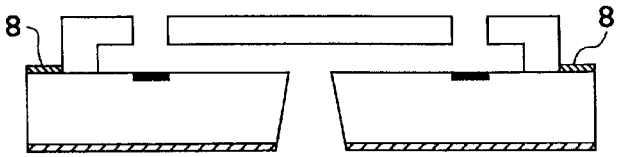

Next, as shown in FIG. 1H, the structure obtained from the above step is dipped into a circulating ethyl cellosolve bath at room temperature for 60 minutes to dissolve and remove the molding member 3, resulting in the formation of an ink channel, thereby completing a key process for manufacturing an ink jet recording head.

Figure 3:
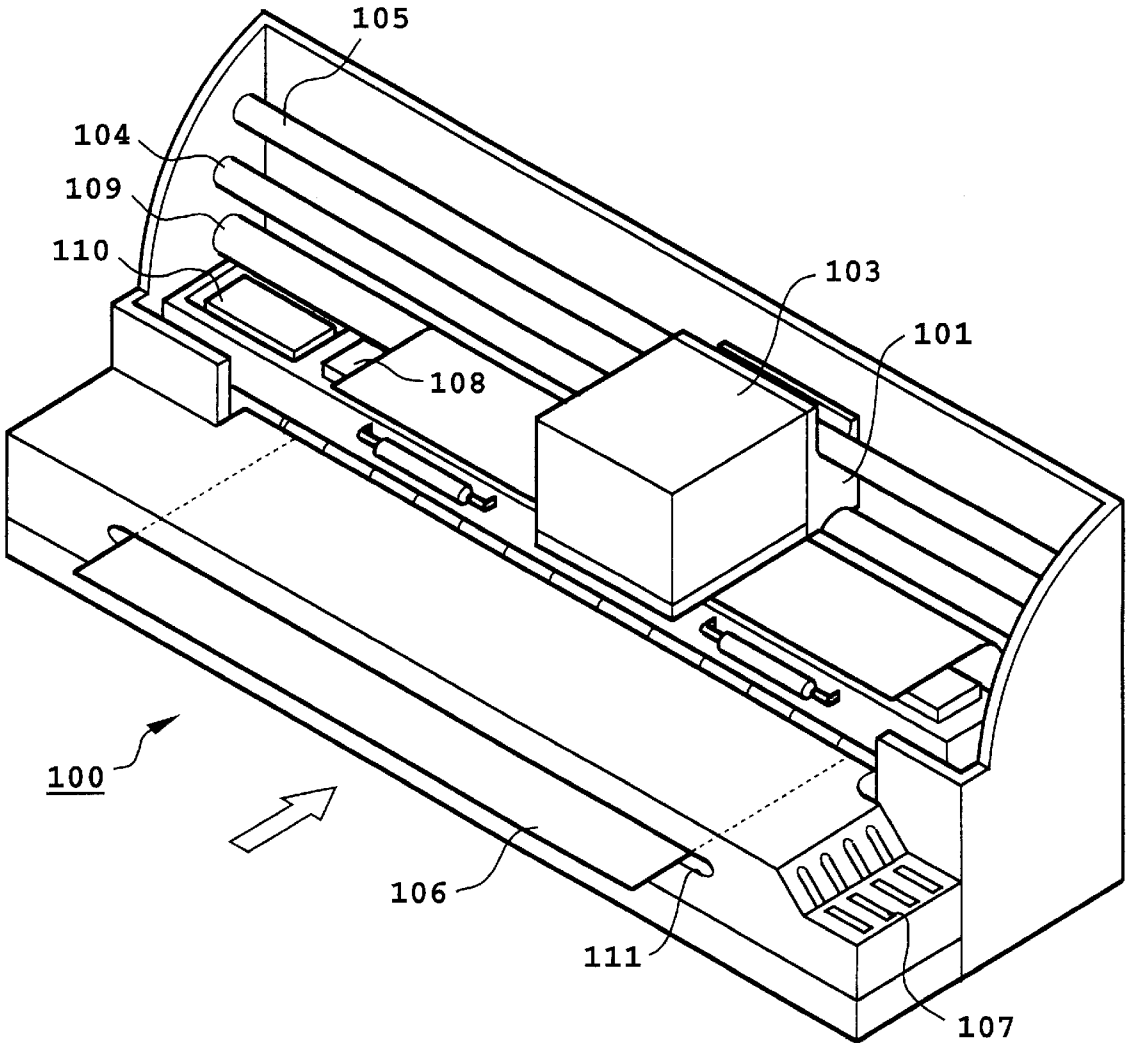
FIG. 3 is a perspective view showing a general configuration of an ink jet recording apparatus using an ink jet recording head manufactured by the above embodiment.

FIG. 3 shows a schematic perspective view showing an example of an ink jet printing apparatus using the ink jet recording head obtained by the above embodiment.

In an ink jet printing apparatus 100, a carriage 101 slidably attaches to two guide shafts 104 and 105 extending in parallel. This configuration allows the carriage 101 to move along the guide shafts 104 and 105 by means of a drive motor and a driving force-transmitting mechanism such as a belt (neither of them shown) which transmits driving force from the drive motor. The carriage 101 comprises an ink jet unit 103 having ink jet recording heads and ink reservoirs that store inks injected from the heads.

The ink jet unit 103 generally has four ink jet recording heads for injecting four color inks, that is, black (Bk), cyan (C), magenta (M), and yellow (Y), and reservoirs corresponding to these heads. The numbers of the ink jet recording heads and the corresponding ink reservoirs can be varied as required. The term "ink", as used herein, means not only one containing colorants to form images but also one containing chemicals for providing various characteristics for print media or formed images. The number and type of the inks can be selected as required. The heads and the reservoirs are mutually removable, and may be configured so that if any ink reservoir becomes empty, only this reservoir can be replaced with a new one. In this case, the ink reservoirs may be such that each reservoir can be replaced independently of the other reservoirs. Of course the head alone can be replaced with a new one as required. Further, the ink jet recording heads and the reservoirs may be integrally configured.

Paper 106, a print medium, is inserted from an insertion slot 111 formed, for example, at a front end of the apparatus, and then transferred by a feed roller 109 to under a movement area of the carriage 101 after reversing its transfer direction finally. Then, the heads mounted on the carriage 101 inject, in synchronism with movement of the carriage 101, the inks onto a print area of the paper 106, which is supported by a platen 108. In this manner, printing is carried out. That is, the overall paper 106 is printed while alternating a printing operation performed simultaneously with the movement of the carriage 101 over a width corresponding to the range of the injection opening arrangement of the head, and an operation of feeding the paper 106. The paper 106 is then ejected forward from the apparatus. In FIG. 3, the print medium is supplied and ejected from a front surface of the apparatus, but may be supplied and ejected from a rear surface thereof. This selection depends on the intended use.

The print media may be papers such as ordinary paper, coat paper, glossy paper, synthetic paper, or cardboards; fabrics; metal; resins; woods; or glass, etc. The print media are not limited to sheets but may have a non-planar three-dimensional shape. The configuration of the recording apparatus may be changed as appropriate depending on the shape and characteristics of the target print media.

A recovery unit 110 can be provided at a left end of the movement range of the carriage 101 so as to be opposed to the heads on the carriage 101 thereunder. The recovery unit 110 can perform an operation of capping a face of each head with the injection openings arranged therein during a non-recording period or the like, an operation of sucking the ink from the injection openings of each head, and the like. In addition, a predetermined position at this left end portion is set as a home position of the head.

On the other hand, the apparatus has an operation section 107 formed at a right end thereof and including switches and display elements. The switches in the operation section 107 are used, for example, to turn on/off the apparatus power supply and to set print modes, and the display elements serve to display states of the apparatus.

The arrangements of the recovery unit 110 and operation section 107 in FIG. 3 are only illustrative and may be changed as appropriate depending on the intended use of the apparatus.

OTHER FEATURES

In addition, in the case that an ink jet recording method is applied, the present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, which are incorporated herein by reference, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262, both of which are incorporated herein by reference, are preferable. In addition, it is preferable that the rate of temperature rise of the heating portions described in U.S. Pat. No. 4,313,124 incorporated herein by reference be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) incorporated herein by reference, in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied at the room temperature. This is because in the ink jet system, the ink is generally temperature adjusted in a range of 30 to 70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-open Nos. 54-56847 (1979) or 60-71260 (1985), both of which are incorporated herein by reference. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method for manufacturing an ink jet recording head for ejecting ink, the method comprising the steps of:

providing a substrate having a device surface on which elements constituting an ink jet recording head are provided;

forming an adhesive layer on the device surface;

providing principal functional parts of the ink jet head on the adhesive layer, at the same time exposing the adhesive layer in peripheries of the principal functional parts of the substrates;

covering the adhesive layer and the principal functional parts of the ink jet head with an etching-protective layer;

etching the substrate from a surface opposite to the device surface to form an ink supply port; and removing the etching-protective layer from the substrate.

2. A method for manufacturing an ink jet recording head according to claim 1, wherein the adhesive layer is formed of a poly-etheramide resin.

3. A method for manufacturing an ink jet recording head according to claim 1 or 2, wherein the etching-protective layer is a cyclized rubber-based coating agent.

4. An ink jet recording head manufactured by the method according to claim 1.

5. An ink jet recording head according to claim 4, wherein said recording head applies thermal energy to an ink to generate bubbles in the ink so that the ink is ejected due to a pressure applied by the bubbles.

6. An ink jet recording apparatus for carrying out recording using an ink jet recording head for ejecting inks, the ink jet recording head being manufactured by means of a manufacturing method comprising the steps of:

providing a substrate having a device surface on which elements constituting an ink jet recording head are provided;

forming an adhesive layer on the device surface;

providing principal functional parts of the ink jet head on the adhesive layer, at the same time exposing the adhesive layer in peripheries of the principal functional parts of the substrates;

covering the adhesive layer and the principal functional parts of the ink jet head with an etching-protective layer;

etching the substrate from a surface opposite to the device surface to form an ink supply port; and removing the etching-protective layer from the substrate.

7. An ink jet recording apparatus according to claim 6, wherein said adhesive layer is formed of a poly-etheramide resin.

8. An ink jet recording apparatus according to claim 6, wherein said etching-protective layer is a cyclized rubber-based coating agent.

9. An ink jet recording apparatus according to any one of claims 6 to 8, wherein said recording head applies thermal energy to an ink to generate bubbles in the ink so that the ink is ejected due to a pressure applied by the bubbles.

* * * * *

UNITED STATES PATENT AND TRADEMARK OFFICE

CERTIFICATE OF CORRECTION

PATENT NO. : 6,508,946 B1
DATED : January 21, 2003
INVENTOR(S) : Keiichi Murakami It is certified that error appears in the above-identified patent and that said Letters Patent is hereby corrected as shown below:

Title page,
Item [57], ABSTRACT,
Line 7, "resister" should read -- resistor --.

Column 1,
Lines 30, 43 and 47, "above described" should read -- above-described --; and
Line 34, "throughholes." should read -- through holes --;

Column 2,
Line 54, "another" should read -- other --.

Column 3,
Line 5, "above" should read -- above- --.

Column 4,
Lines 14, 28 and 30, "resister" should read -- resistor --;
Lines 22 and 62, "above described" should read -- above-described --;
Line 57, "of" should read -- for --;
Line 58, "have" should read -- has -- and "an" should read -- a --; and Column 5,
Line 5, "head." should read -- heads. --;
Line 19, "above described" should read -- above-described --; and
Line 25, "Ltd.))," should read -- Ltd.), --.

Column 6,
Line 9, "resister" should read -- resistor --;
Line 18, "above described" should read -- above-described --;
Line 36, "10" should be deleted;
Line 39, "over" should read -- cover --;
Line 49, "hr." should read -- hours. --;
Line 51, "the" (first occurrence) should be deleted; and
Line 53, "conventinal" should read -- conventional --.

UNITED STATES PATENT AND TRADEMARK OFFICE

CERTIFICATE OF CORRECTION

PATENT NO. : 6,508,946 B1 
DATED : January 21, 2003
INVENTOR(S) : Keiichi Murakami It is certified that error appears in the above-identified patent and that said Letters Patent is hereby corrected as shown below:

Column 8,
Line 49, "to" should read -- into --.

Column 9,
Line 2, "consists" should read -- consist --.

Signed and Sealed this

Seventh Day of October, 2003

JAMES E. ROGAN
*Director of the United States Patent and Trademark Office*